United States Patent [19]

Mayer et al.

[11] Patent Number: 4,963,397

[45] Date of Patent: Oct. 16, 1990

[54] PAPER COATING SYSTEM AND METHOD

[75] Inventors: Michael A. Mayer, Stevens Point; Lucien L. Mason, Nekoosa; Leonard C. Olson; Keith H. Riemer, both of Wisconsin Rapids, all of Wis.

[73] Assignee: Consolidated Papers, Inc., Wisconsin Rapids, Wis.

[21] Appl. No.: 390,605

[22] Filed: Aug. 7, 1989

Related U.S. Application Data

[63] Continuation of Ser. No. 172,377, Mar. 24, 1988, abandoned.

[51] Int. Cl.[5] ..... B05D 3/12

[52] U.S. Cl. ..... 427/356; 427/371; 427/428

[58] Field of Search ..... 427/428, 356, 371

[56] References Cited

U.S. PATENT DOCUMENTS

| | | | |
|---|---|---|---|
| 3,192,895 | 7/1965 | Galer | 118/126 |
| 3,302,610 | 2/1967 | Mahoney | 427/428 |
| 3,486,482 | 12/1969 | Hunger | 118/603 |
| 3,518,964 | 7/1970 | Nagler | 118/65 |
| 4,310,593 | 1/1982 | Gross | 428/290 |
| 4,396,648 | 8/1983 | Holt et al. | 427/356 |
| 4,452,833 | 6/1984 | Holt | 427/356 |

*Primary Examiner*—Bernard Pianalto

*Attorney, Agent, or Firm*—Juettner Pyle Lloyd & Verbeck

[57] ABSTRACT

A paper coating system is characterized by an upstream dip roll applicator that applies an excess layer of liquid coating material onto a surface of a paper web, and an improved downstream doctor assembly for metering and leveling the coating on the web. The doctor assembly includes a doctor blade having a tip extended against and across the web and a shear plate, upstream of the blade, having a surfaces extending across and defining a gap with the web. An elongate chamber defined between the shear plate and blade extends across the web, and excess coating removed from the web by the blade flows into the chamber. Coating is drained from and uniformly along a lower end of the chamber at a rate to maintain an eddy current pool of coating in an upper end of the chamber immediately upstream of the blade/web nip, but to prevent formation of a liquid seal in the gap. The eddy current pool of coating rewets the excess coating on the web just prior to the blade to level and smooth streaky film split patterns that occur from dip roll application, so the blade doctors the coating very uniformly and a very uniform coating is on the finished paper sheet. To further improve uniformity, the shear plate is adjusted so that the gap is sufficiently small to prevent any outflowing coating from spattering onto the incoming web, yet large enough to prevent formation of a liquid seal in the gap.

15 Claims, 3 Drawing Sheets

PAPER COATING SYSTEM AND METHOD

This is a continuation of copending application Ser. No. 07/172,377 filed on Mar. 24, 1988 now abandoned.

BACKGROUND OF THE INVENTION

The present invention relates to paper coaters generally, and in particular to an improved doctor assembly for a dip roll coating system, and a method of coating paper in which film split and streaking patterns in a coating applied onto a paper web are significantly minimized.

Paper coating processes continue to be performed at faster web speeds to increase productivity. At the same time, paper quality continues to rise because of printer demands, necessitating increasingly higher coat weights to produce paper of the required quality. The standard paper coating system for high coat weights and high web speeds has been the dip roll coater. Essentially, to apply a high weight of coating onto the surface of a paper web traveling at a high rate of speed, a dip roll applicator applies an excess of coating onto the web as it is carried through a nip between the dip roll and a backing roll. Downstream from the dip roll, the coating is doctored on the web by a blade.

Dip roll coating application has long been plagued by narrow streaky coating lay caused by film splitting that occurs as the dip roll rotates away from the web on the outgoing side of the backing roll/dip roll nip. At high web speeds, the dip roll produces a severe film split pattern in the excess coating layer applied onto the web, i.e., separations or thin areas occur in the coating, extending along the direction of web travel. The narrow coating bands created at the backing roll/dip roll nip travel on the coated web to the blade, and as coater speeds increase, especially above 2500 fpm and faster, the film split pattern becomes unacceptably severe. When this nonuniform layer of excess coating impacts the blade, it exerts varying impulse forces against the blade and is doctored nonuniformly. In consequence, the film split pattern is not completely removed by the blade and appears as narrow machine direction banding in the finished sheet, and the higher the coat weight, coating material viscosity and web speed, the more pronounced is the film split pattern. In addition, when the excess coating impacts the doctor blade, some spatters back and lands on the web upstream of the blade. This turbulent spattering becomes more violent as coater speeds increase, producing blotchy patterns that are visible in the finished sheet.

OBJECTS OF THE INVENTION

An object of the invention is to provide a dip roll paper coating system and method of operation of the system having an improved doctor assembly that significantly minimizes streaky film split patterns in coating applied onto a paper web.

Another object is to provide such a system, and method in which the doctor assembly significantly minimizes film split patterns by rewetting the excess coating layer on the web just prior to doctoring the coating.

A further object is to provide such a system, and method in which an eddy current pool of coating is developed immediately upstream of a doctor blade of the doctor assembly for rewetting the excess coating on the web to smooth and level the coating immediately prior to blading the same.

Yet another object is to provide such a system, and method in which the doctor assembly prevents coating impacting the blade from spattering back onto the web surface upstream of the blade.

SUMMARY OF THE INVENTION

In accordance with the present invention, a paper coating system comprises means for applying an excess layer of liquid coating material onto a surface of a paper web traveling at a relatively high rate of speed, and a downstream doctor assembly for metering and leveling the excess coating on the web. The doctor assembly includes a doctor blade having a tip extended against and across the web surface, and means for forming coating removed from the web by the blade into an eddy current pool of coating extending transversely across and in contact with the coating layer on the web immediately upstream of the blade and downstream of and spaced from the means for applying. The eddy current pool of coating rewets, smooths and levels the excess coating layer on the web before it reaches the blade, so the coating layer doctored by the blade on the web is very uniform, variations in impulse forces of the coating layer against the blade are minimized, and the blade doctors the coating on the web very uniformly. In a contemplated embodiment, the means for applying comprises a dip roll applicator and the web travels at a speed of at least 2500 fpm.

The invention also provides a method of metering and leveling an excess layer of liquid coating material on a web of paper traveling at a relatively high rate of speed, which includes the step of extending a tip of a doctor blade against and across the web surface to doctor the coating on and remove coating from the surface. Also included is the step of forming the coating removed by the blade into an eddy current pool of coating extending transversely across the web in contact with the excess coating layer on the web immediately upstream of the blade to rewet, smooth and level the excess coating layer on the web before it reaches the blade. The coating layer doctored by the blade on the web is therefore very uniform, so the blade doctors the coating very uniformly. In a contemplated embodiment of the method, coating liquid is applied onto the web by a dip roll applicator and the web is moved at a speed of at least 2500 fpm.

The foregoing and other objects, advantages and features of the invention will become apparent upon a consideration of the following detailed description, when taken in conjunction with the accompanying drawings.

DETAILED DESCRIPTION

Figure 1:
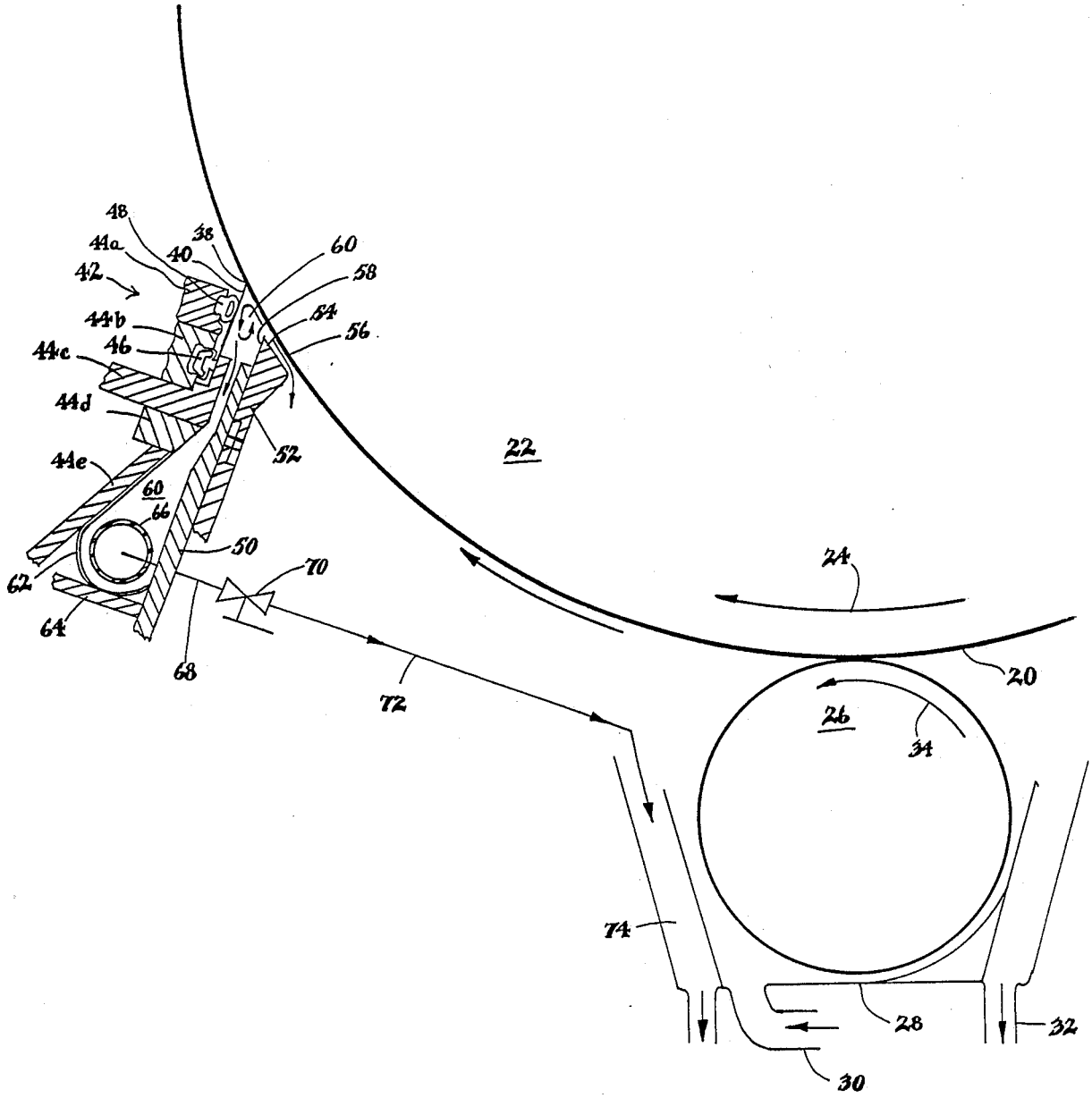
FIG. 1 illustrates a dip roll paper coating system having a doctor assembly configured according to one embodiment of the invention.
Figure 2:
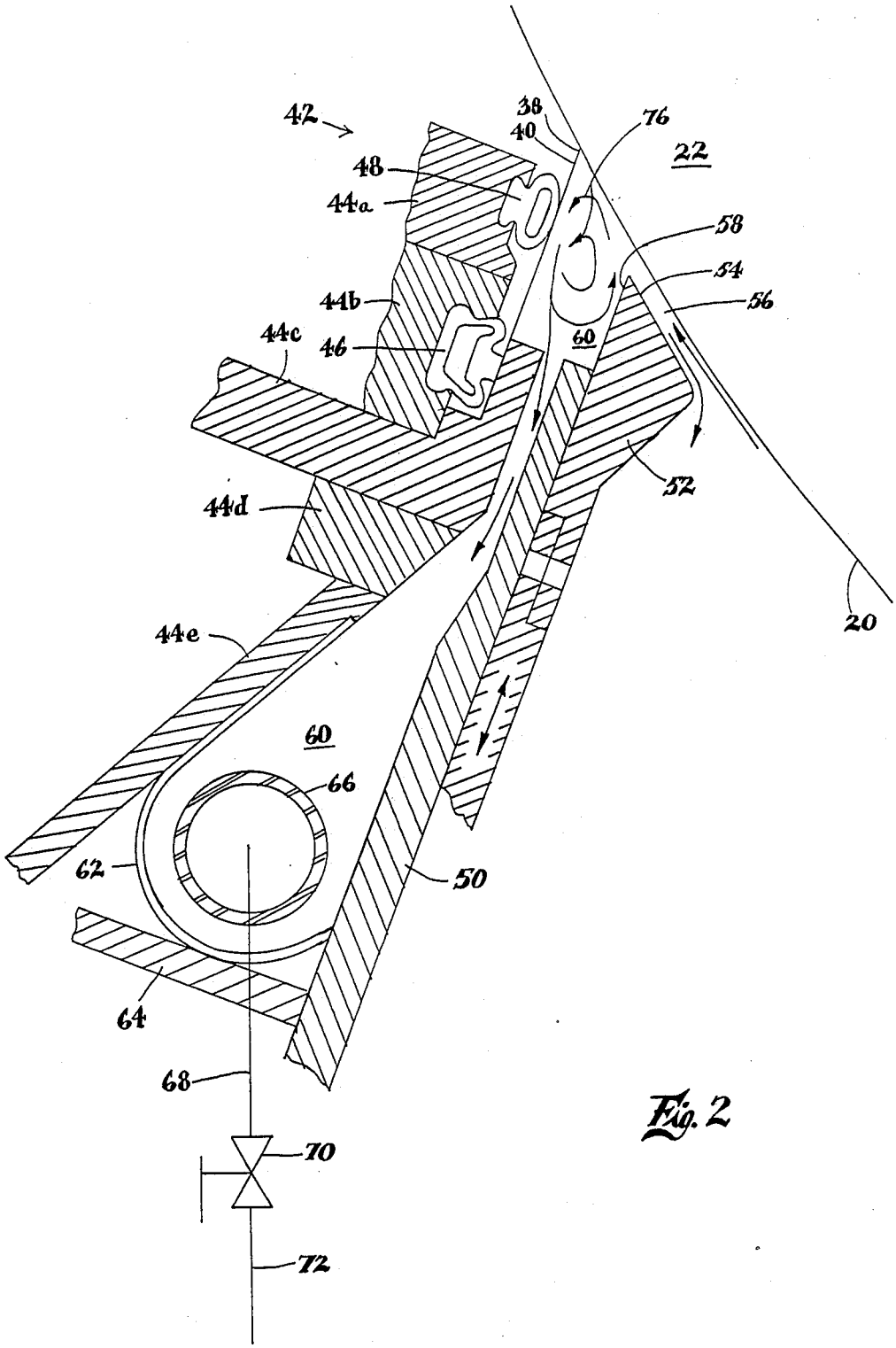
FIG. 2 is an enlarged view of the doctor assembly.
Figure 3:
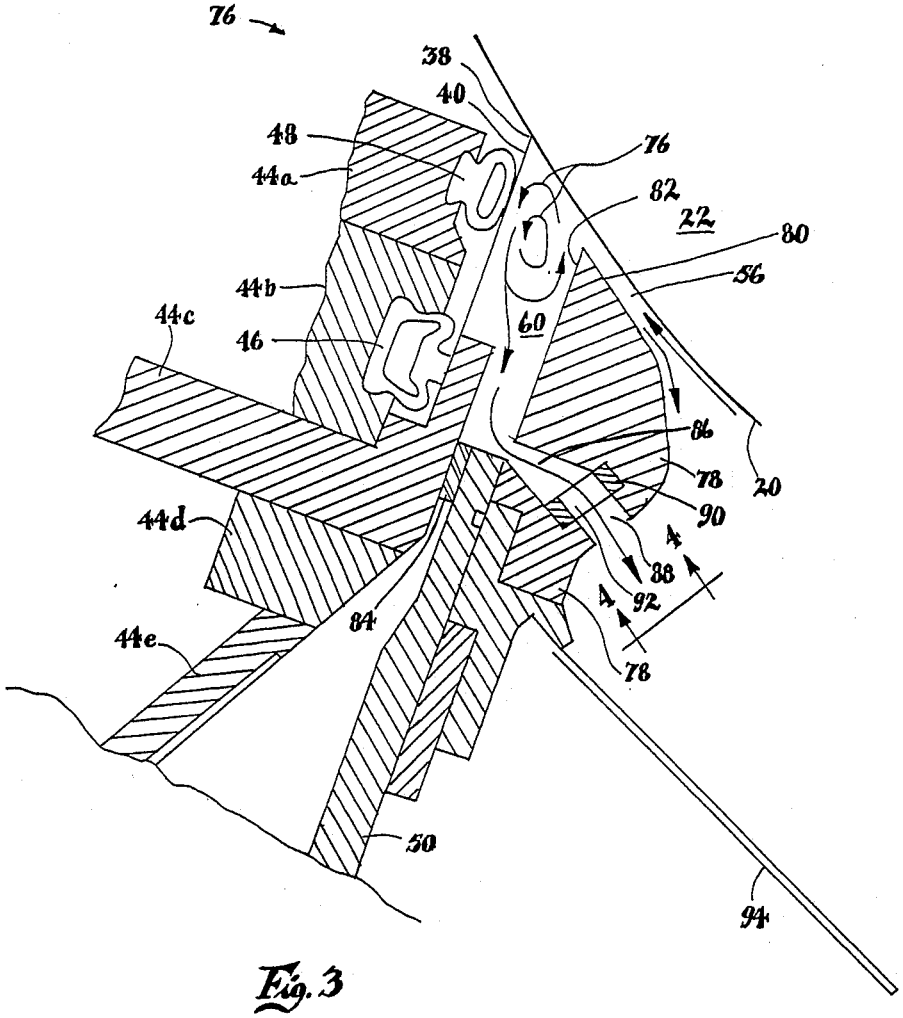
Figure 4:
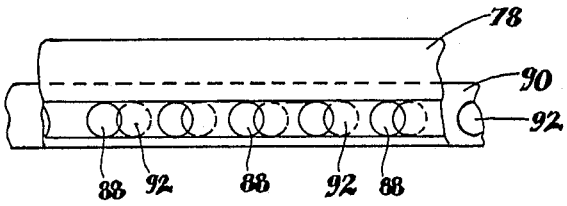

The paper coating system of FIG. 1 is for applying liquid coating material onto a surface of a web of paper 20 carried on a backing roll 22 in a direction shown by an arrow 24. The system includes a dip roll applicator 26, mounted for rotation in a pan 28 having an inlet 30 through which coating liquid is introduced to maintain a reservoir of coating in contact with the roll and an outlet 32 through which excess coating leaves the pan. The backing and dip rolls extend transversely of the web in the cross machine direction, and the dip roll is rotated in a direction indicated by an arrow 34, usually at a rate such that its surface travels slightly slower than the web, so that coating picked up on its surface from the pan is carried and transferred to the web surface as the web travels through a nip between the dip and backing rolls. The dip roll transfers an excess of coating to the web, and downstream from the dip roll a tip 38 of a doctor blade 40 of a doctor assembly 42 extends against and transversely across the web to meter and level the excess coating on the web.

Paper coating processes continue to be performed at faster web speeds to increase productivity, and paper quality continues to rise because of printer demands, necessitating higher coat weights to achieve the required quality. The standard coating system for high coat weights and high web speeds has been the dip roll coater. However, at high web speeds the excess coating layer applied onto the web by the dip roll develops streaky film split patterns as the dip roll rotates away from the web on the outgoing side of the dip roll/backing roll nip, i.e., separations or thin layers occur in the coating, extending along the direction of web travel. When the nonuniform excess layer of coating is doctored by a blade of a conventional doctor assembly, it exerts varying impulse forces against the blade and is doctored nonuniformly. In consequence, a film split pattern occurs in the finished sheet, that appears as narrow machine direction banding, and the higher the coating viscosity and coat weight, and the faster the speed of travel of the web, the more pronounced is the pattern. At web speeds on the order of 2500 fpm and faster, with conventional doctor assemblies the film split pattern becomes unacceptable.

A further problem encountered with dip roll coaters having conventional doctor assemblies, which becomes more severe with increasing web speeds, is that when the excess coating on the web impacts the doctor blade, some spatters back and lands on the web upstream of the blade. The spattering becomes more violent as coater speed increases, and result in blotchy patterns that are visible in the coating on the finished sheet.

In overcoming these disadvantages and to enable a dip roll to apply coating onto a paper web traveling at high speed, without occurrence of streaky film split patterns in the finished sheet, the invention provides a novel doctor assembly in which a "shear plate" is upstream of a doctor blade and spaced from both the web and blade to define a gap with the web and an elongate chamber with the blade. Excess coating removed from the web by the blade flows into the chamber and is drained from a lower end of and uniformly along the longitudinal extent of the chamber to control the height of liquid in an upper end of the chamber, and the shear plate is positioned to control the size of the gap. Draining of coating from the chamber is controlled by a valve that is opened by an amount to maintain an eddy current pool of coating at the blade/web nip, but to prevent a significant reverse flow of coating through and formation of a liquid seal in the gap so that coating in the chamber is not pressurized. The eddy current pool redeposits coating onto the web immediately upstream of the blade, and the shear plate is simultaneously adjusted to define a gap that is sufficiently small to prevent any outflowing coating from spattering onto the incoming web, yet sufficiently large to prevent forming a liquid seal in the gap.

Redeposition of coating by the eddy current pool just prior to the blade rewets the excess coating layer on the web to smooth and level streaky film split patterns caused by dip roll application. In addition, eliminating an excessive reverse flow of coating through the gap between the shear plate and web controls an otherwise violent turbulence of coating that can be seen returning from the blade in the upstream direction in conventional dip roll coating systems. Such turbulence becomes more pronounced as coater speeds increase, causing spattering of coating onto the web upstream of the blade and blotchy patterns that are visible in the coating on the finished sheet. The invention therefore improves overall coating lay not only by rewetting the excess coating layer on the web immediately prior to doctoring the layer, but also by eliminating turbulent spattering of coating back onto the web upstream of the blade. In addition, the shear plate protects the blade from continually being impacted by a spray of coating emanating from the dip roll/backing roll nip to further minimize impulse forces of coating against the blade. A high coat weight may therefore be applied onto a high speed web with only minimal, if any, film split and/or blotchy patterns appearing in the coating on the finished sheet.

Referring to the drawings, the novel doctor assembly 42 is downstream of and spaced from the dip roll 26. It extends transversely across the web 20 in the cross machine direction, and includes rearward or downstream frame members 44*a–e*. The blade 40 is clamped at its lower end to the frame member 44*c* by a pneumatic tube 46, and the blade tip 38 is urged against the web with a force controlled by pressure in a pneumatic tube 48. The assembly also includes a front wall 50 on which is carried a vertically adjustable shear plate 52. The shear plate has a generally planar upper surface 54 that is elongate in the direction of web travel and spaced from the web to define with the web an elongate gap 56 that may progressively increase in size in the upstream direction, with overall gap size being controlled by vertical adjustment of the shear plate. A rearward surface 58 of the shear plate is spaced from the doctor blade to define therebetween an upper end of an elongate chamber 60 that extends transversely across the web. From its upper end, the chamber extends downwardly between the frame members 44*c–e* and the front wall 50 to a lower end closed by a generally J-shaped wall 62 carried by both the frame member 44*e* and a base wall 64. A drain conduit 66 extends longitudinally across the chamber lower end, a plurality of passages extend through and are spaced longitudinally along the conduit, and the conduit interior connects through a drain line 68 to an inlet to an adjustable drain valve 70. A drain line 72 connects an outlet from the valve to a coating return line 74.

In operation of the doctor assembly 42, as the excess coating layer applied onto the web 20 by the upstream dip roll 26 contacts the doctor blade 48, excess coating bladed from the web flows into the chamber 60, substantially fills the chamber and, by virtue of movement of the web 20 across the top of the chamber, forms a uniform eddy current pool of very low pressure, low turbulence coating material extending transversely across and in contact with the web upstream of and at the blade/web nip. This is accomplished by adjusting the valve 70 to drain coating from and uniformly along the longitudinal extent of the chamber lower end at a rate to control the height and pressure of coating in the chamber upper end, and by vertically adjusting the shear plate 52 so its upper surface 54 establishes a gap 56 of desired size.

Specifically, the valve 70 is adjusted to control accumulation of coating in the chamber in a manner to maintain the eddy current pool 76 of coating in the chamber upper end to be of a size sufficiently large to rewet the coating on the web but sufficiently small so that no or only a limited amount of coating flows from the chamber reversely through the gap 56. The valve is opened by an amount to establish and maintain the eddy current pool at and just upstream of the blade/web nip, but to prevent formation of a liquid seal in the gap, since a seal would adversely cause pressurization of coating in the chamber as coating and/or air are carried into the chamber by the web. It is important that the eddy current pool be maintained at a very low pressure, preferably a pressure approaching zero psi, to avoid undesirable turbulence of the eddy current pool and pressure pulsations on the blade that can cause nonuniformities in doctoring. It is also important that coating be drained uniformly along the longitudinal extent of the chamber lower end to uniformly control the height of the eddy current pool longitudinally along the chamber upper end. To aid in adjusting the amount of opening of the valve, while visually observing the upstream end of the gap, the valve may be opened to a point where coating liquid just flows slowly reversely out of the gap, which limited flow also keeps the shear plate upper surface 54 clean. The valve must be opened enough, however, to prevent a flow of coating, reversely through the gap, of a volume sufficient to cause spattering of coating exiting the gap onto the web upstream of the gap, and certainly enough to prevent forming a liquid seal in the gap and pressurization of the chamber. Coating drained from the chamber through the valve then flows through the lines 72 and 74.

In addition to adjusting the valve 70, the shear plate 52 is also vertically adjusted on the front wall 50 to control the gap 56 to be of a size sufficiently small to prevent spattering of any outflowing coating onto the web, yet sufficiently large to prevent forming a liquid seal in the gap.

The eddy current pool 76 of coating contacts and rewets the excess coating layer applied onto the web 20 by the dip roll 26, which excess layer has yet to reach the doctor blade 40. Thus, there is a redeposition of coating onto the web to smooth and eliminate, or at least substantially minimize, nonuniformities such as streaky film split patterns in the excess coating layer just upstream of the blade, resulting in a much more uniform coating layer for being doctored by the blade. In consequence, the blade doctors the coating very uniformly, and a high coat weight may be applied onto the web without coating nonuniformities appearing on the finished sheet. Simultaneously, adjustment of the valve 70 to limit any outflow of coating reversely through the gap 56 between the shear plate 52 and web, together with adjustment of gap size, prevents pressurization of the eddy current pool and controls spattering of coating toward the dip roll, so blotchy patterns are eliminated or at least minimized on the finished sheet. Should any spattering occur, the spatter pattern will be substantially smoothed and leveled, prior to blading, by the eddy current pool of coating.

The invention therefore provides an improved dip roll paper coating system and a method of coating paper, in which overall coating lay is significantly improved by rewetting the excess coating layer on the web immediately prior to blading the layer, thereby to substantially eliminate film split and blotchy patterns that normally occur in coating applied onto a high speed web by conventional dip roll coating systems. In addition, the shear plate 52 protects the coater blade 40 from continually being impacted by a coating spray normally emanating from the outgoing side of the dip roll nip, which minimizes pressure pulsations on the blade for improved coating uniformity. By virtue of the adjustable valve 70, and the shear plate, the doctor assembly can be controlled to account for variations in web speed, excess coating thickness and coating viscosity, in a manner to provide a very uniform coating on the finished sheet.

While one embodiment of the invention has been described in detail, various modifications and other embodiments thereof may be devised by one skilled in the art without departing from the spirit and scope of the invention, as defined in the appended claims.

What is claimed is:

1. A method of metering and leveling an excess layer of liquid coating material applied onto a web of paper traveling at a high rate of speed, comprising the steps of extending a doctor against and across the surface of the web, at a point downstream and spaced from the point of application of the excess coating layer onto the web, to doctor the coating on and remove excess coating from the surface; establishing an elongate chamber extending across the web upstream from the doctor, the chamber having an upper end adjacent to the web and a lower end; flowing excess coating removed from the web by the doctor into the chamber; forming the excess coating in the chamber into an eddy current pool of coating in the chamber upper end and extending transversely across the web in contact with the excess coating layer on the web substantially immediately upstream from the doctor to rewet, smooth and level nonuniformities in the excess coating layer on the web before it reaches the doctor; and controllably draining coating through an adjustable valve from and uniformly longitudinally along the chamber lower end at a rate to maintain the eddy current pool of coating in the chamber upper end uniformly in contact with the web across the transverse extent thereof, whereby the excess coating layer doctored on the web is very uniform and is doctored very uniformly.

2. A method as in claim 1, wherein said forming step forms the eddy current pool of coating at a nip between the doctor and web.

3. A method as in claim 1, wherein said controllably draining step maintains the eddy current pool of coating substantially unpressurized.

4. A method as in claim 1, including the step of establishing a gap, adjacent to and transversely across the web, at an upstream end of the chamber upper end, said controllably draining step comprising adjusting the valve to controllably drain coating from and uniformly longitudinally along the chamber lower end at a rate to prevent a reverse flow of coating from the chamber upper end through the gap.

5. A method as in claim 1, including the step of establishing a gap, adjacent to and transversely across the web, at an upstream end of the chamber upper end, said controllably draining step comprising adjusting the valve to controllably drain coating from and uniformly longitudinally along the chamber lower end at a rate to allow a limited reverse flow of coating from the chamber upper end through the gap.

6. A method as in claim 5, including the step of controlling the size of the gap to be sufficiently small to prevent the limited reverse flow of coating therethrough from spattering onto the excess coating layer on the web but sufficiently large to prevent the reverse flow of coating from forming a liquid seal in the gap.

7. A method as in claim 1, including the step of causing the web to travel at a speed of at least 2500 fpm.

8. A method of coating a surface of a moving web of paper, comprising the steps of applying an excess layer of liquid coating material onto the surface of the web with a dip roll applicator; extending a doctor against and transversely across the surface of the web at a point downstream and spaced from the dip roll applicator to doctor the coating on and remove excess coating from the web surface; moving the web across the dip roll applicator and doctor at a relatively high rate of speed; establishing an elongate chamber adjacent to and upstream from the doctor, the chamber having an upper end adjacent the web and a lower end; flowing excess coating removed from the web by the doctor into the chamber; forming the excess coating in the chamber into an eddy current pool of coating in the chamber upper end and extending transversely across the web in contact with the excess coating layer on the web substantially immediately upstream from the doctor to rewet, smooth and level nonuniformities in the excess coating layer on the web before it reaches the doctor; and controllably draining coating through an adjustable valve from and uniformly longitudinally along the chamber lower end at a rate to maintain the eddy current pool of coating in the chamber upper end uniformly in contact with the web across the transverse extent thereof, so that the excess coating layer doctored on the web is very uniform and is doctored very uniformly.

9. A method as in claim 8, wherein said forming step forms the eddy current pool of coating at a nip between the doctor and web.

10. A method as in claim 8, wherein said controllably draining step maintains the eddy current pool of coating substantially unpressurized.

11. A method as in claim 8, including the step of causing the web to travel at a speed of at least 2500 fpm.

12. A method as in claim 8, including the step of establishing a gap, adjacent to and transversely across the web, at an upstream end of the chamber upper end, said controllably draining step comprising adjusting the valve to controllably drain coating from and uniformly longitudinally along the chamber lower end at a rate to maintain the eddy current pool of coating in the chamber upper end but to prevent a reverse flow of coating from the chamber upper end through the gap.

13. A method as in claim 12, wherein said step of establishing a gap establishes a gap that is elongate in the direction of web travel and progressively increases in size from a downstream to an upstream end thereof.

14. A method as in claim 8, including the step of establishing a gap, adjacent to and transversely across the web, at an upstream end of the chamber upper end, said controllably draining step comprising adjusting the valve to controllably drain coating from and uniformly longitudinally along the chamber lower end at a rate to maintain the eddy current pool of coating in the chamber upper end and to cause a limited reverse flow of coating from the chamber upper end through the gap.

15. A method as in claim 14, including the step of controlling the size of the gap to be sufficiently small to prevent the limited reverse flow of coating therethrough from spattering onto the excess coating layer on the web but sufficiently large to prevent the reverse flow of coating from forming a liquid seal in the gap.

* * * * *